United States Patent [19]

May et al.

[11] Patent Number: 4,659,487

[45] **Date of Patent: * Apr. 21, 1987**

[54] CONCENTRATED FABRIC SOFTENERS

[75] Inventors: Adolf May, Hofheim am Taunus; Hans-Walter Bücking, Kelkheim; Manfred Schreiber, Frankfurt am Main, all of Fed. Rep. of Germany

[73] Assignee: Hoechst Aktiengesellschaft, Fed. Rep. of Germany

[ * ] Notice: The portion of the term of this patent subsequent to Oct. 9, 2001 has been disclaimed.

[21] Appl. No.: 804,311

[22] Filed: Dec. 2, 1985

Related U.S. Application Data

[63] Continuation of Ser. No. 461,435, Jan. 27, 1983, abandoned.

[30] Foreign Application Priority Data

Feb. 6, 1982 [DE] Fed. Rep. of Germany ..... 3204165

[51] Int. Cl.[4] ..... D06M 11/00

[52] U.S. Cl. ..... 252/8.8; 252/544

[58] Field of Search ..... 252/8.8, 544

[56] References Cited

U.S. PATENT DOCUMENTS 4,076,632 2/1978 Davis ..... 252/8.8
4,476,030 10/1984 May et al. ..... 252/8.8
4,476,031 10/1984 Ooms ..... 252/8.8

FOREIGN PATENT DOCUMENTS 0018039 10/1980 European Pat. Off. ..... 252/8.8
0056695 7/1982 European Pat. Off. ..... 252/8.8

*Primary Examiner*—Paul Lieberman
*Assistant Examiner*—Willie J. Thompson
*Attorney, Agent, or Firm*—Connolly and Hutz

[57] ABSTRACT

Concentrated fabric softeners consisting substantially of 12 to 50 weight % of a quaternary ammonium compound customary for softeners, 2 to 20 weight of a fatty amine polyglycol ether of the formulae

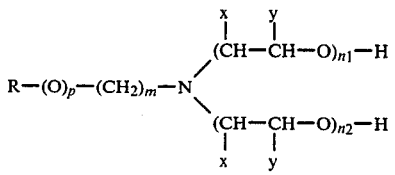

(IV)

in which $R_1$ is alkyl or alkenyl having from 8 to 22, preferably 16 to 18, carbon atoms, x and y each are hydrogen or methyl with the proviso that x and y are not simultaneously methyl, $n_1$ and $n_2$ together are an integer of from 2 to 50, preferably 25, and p and m either are simultaneously zero, or p is 1 and m is 1, 2 or preferably 3, 3 to 30 weight % of a $C_1$–$C_3$ alcohol, an acid in an amount which is equimolar to component (b), and water and optionally further usual auxiliaries in amounts remaining to complete 100%.

5 Claims, No Drawings

CONCENTRATED FABRIC SOFTENERS

This case is a continuation of my copending application, Ser. No. 461,435, filed Jan. 27, 1983, now abandoned.

It is known that textiles which have been washed, especially in an automatic washer, and particularly those made from cellulose fibers, are in an unpleasant hardened state after drying. This undesirably hardened feel can be overcome by treating the textiles after washing in a rinsing bath with cationic substances which contain at least two long-chain aliphatic radicals in the molecule. Especially the dialkyldimethylammonium salts or imidazoline derivates of the formulae I to III (I)

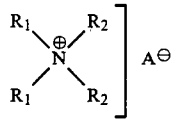

(II)

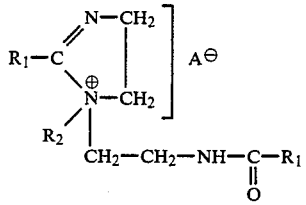

(III)

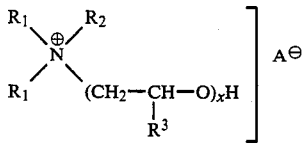

are used in the practice for this purpose.

In these formulae, $R_1$ is alkyl or alkenyl having from 8 to 22, preferably 16 to 18, carbon atoms, $R_2$ is alkyl having from 1 to 4 carbon atoms, preferably methyl, $R_3$ is methyl or hydrogen, x is a number of from 1 to 5 and A is an anion such as $Cl^{(-)}$, $Br^{(-)}$, $CH_3OSO_3^{(-)}$ or $CH_3OPO_3^{(-)}$.

Aqueous dispersions of these raw materials are prepared with cold water up to a concentration of from 10 to 15%. Formulations having a higher concentration, however, become viscous and gelatinous after a short period, and they cannot be dispersed in cold water without gel formation. The following requirements must therefore be met by a good fabric softener concentrate: Good dispersibility in cold water, no thickening of the formulation on storage, no separation thereof into phases, and no formation of bottom deposits.

It has now been found that these requirements can be met when the above quaternary ammonium compounds are combined with a certain amount of a fatty amine polyglycol ether.

Subject of the invention are therefore concentrated fabric softeners consisting substantially of (a) from 12 to 50, preferably 20 to 30, weight % of a compound of the formulae I to III (I)

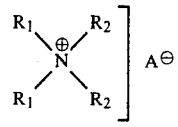

(II)

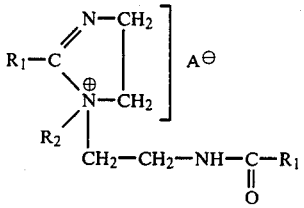

(III)

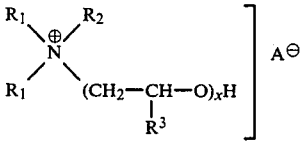

in which $R_1$ is alkyl or alkenyl having from 8 to 22, preferably 16 to 18, carbon atoms, $R_2$ is alkyl having from 1 to 4 carbon atoms, preferably methyl, $R_3$ is methyl or hydrogen, x is a number of from 1 to 5 and A is an anion such as $Cl^{(-)}$, $Br^{(-)}$, $CH_3O\text{-}SO_3^{(-)}$ or $CH_3OPO_3^{(-)}$, (b) from 2 to 20, preferably 2 to 5, weight % of a fatty amine polyglycol ether of the formula IV (IV)

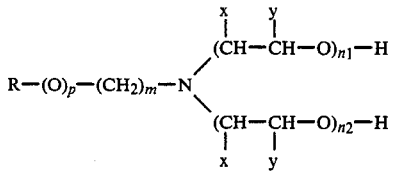

in which $R_1$ is alkyl or alkenyl having from 8 to 22, preferably 16 to 18, carbon atoms, x and y each are hydrogen or methyl with the proviso that x and y are not simultaneously methyl, $n_1$ and $n_2$ together are an integer of from 2 to 50, preferably 25, and p and m either are simultaneously zero, or p is 1 and m is 1, 2 or preferably 3, (c) from 3 to 30, preferably 5 to 15, weight % of a $C_1$–$C_3$-alcohol, (d) an acid in an amount which is equimolar to component (b), and (e) water and optionally further usual auxiliaries in amounts remaining to complete 100%.

The fatty amine polyglycol ethers (b) are commercially available products (Genamin-S trade marks). For preparing the concentrated fabric softeners according to the invention, the cationic softening compounds of the formulae I to III are advantageously used in the form of concentrated solutions in lower alcohols, preferably isopropanol, or in a mixture of these alcohols with water. Therefore, the fabric softeners of the invention contain a certain amount of such lower alcohols. Suitable acids are for example acetic, phosphoric or hydrochloric acid, and they are used in an amount corresponding to an acid equivalent per amino group in the fatty amine polyglycol ether (b).

The concentrated fabric softeners of the invention may contain furthermore other usual substances and auxiliaries such as cationic or nonionic surface-active compounds, solubilizers, for example p-cumene sulfonate, electrolytes, acidifiers, for example phosphoric or acetic acid, organic complexing agents, optical brighteners, dyestuffs or perfumes. They serve for additionally influencing the feel or other properties or the textiles to be treated, or for adjusting the viscosity of the pH, or for increasing the stability to low temperatures.

The concentrated fabric softeners of the invention impart a pleasant and soft feel to any textile material, especially those made from natural or regenerated cellulose, wool, cellulose acetate, cellulose triacetate, polyamide, polyacrylonitrile, polyesters, or polypropylene. Especially advantageous is its use for the after-treatment of terry fabrics and underwear. These fabric softener mixtures are prepared by simply mixing or dispersing the individual components in water. They may contain one compound each of the formulae I to III in combination with IV, or a mixture of two or more compounds of these formulae I to III within the ranges as indicated. In the case of a mixture of two or more compounds of the formulae I to III, the mixing ratio thereof with one another is not at all critical and may have any value.

The fabric softener concentrates are applied as usual, that is, they are added to the last rinsing water after the washing operations are complete. The textiles so treated are subsequently dried. Alternatively, the concentrates may be previously diluted to a content of 4 to 8% of active substance, as this is usual in the case of commercial softeners. Using a correspondingly smaller amount of water, the so-called 3-fold to 10-fold concentrates can be also prepared.

The above fabric softener concentrates have good softening properties. They are distinguished by a good stability, and their dispersibility in cold water is excellent. Gel formation was not absorved. Even in a highly concentrated form, the formulations have a low viscosity. Thickening or gelling after prolonged storage does not occur.

Furthermore, an improved feel was observed, so that surprisingly the fatty amine polyglycol ethers act not only as emulsifier but also as softening component. Alone, these fatty amine polyglycol ethers have no softening effect, because they are not absorbed by the fabric.

In the following Examples, some fabric softeners of the invention are described. Percentages are by weight in all cases. The softeners have been prepared in all cases by simply stirring aqueous solutions of the individual components with one another in cold state.

EXAMPLE 1

| | |
|---|---|
| Distearyl-dimethylammonium chloride | 30% |
| stearylamine + 25 EO (ethylene oxide) | 4% |
| $H_3PO_4$ (1 molar) | 3 ml |
| $MgCl_2$ solution (10% strength) | 2 ml |
| water (0° German hardness), perfume, dyestuff, ad | 100% |

EXAMPLE 2

| | |
|---|---|
| Di-tallow fatty alkyl-methyloxy-propylammonium chloride | 40% |
| oleylamine + 20 EO | 10% |
| $H_3PO_4$ (1 molar) | 7 ml |
| $MgCl_2$ solution (10% strength) | 3 ml |
| water (0° German hardness), perfume, dyestuff, ad | 100% |

EXAMPLE 3

| | |
|---|---|
| Di-stearylalkyl-imidazolinium-methosulfate | 25% |
| tallow fatty amine + 30 EO | 5% |
| $H_3PO_4$ (1 molar) | 4 ml |
| $MgCl_2$ (10% strength solution) | 1 ml |
| water (0° German hardness), perfume, dyestuff, ad | 100% |

EXAMPLE 4

| | |
|---|---|
| Di-tallow fatty alkyl-dimethylammonium chloride | 35% |
| stearylamine + 30 EO | 5% |
| $H_3PO_4$ (1 molar) | 5 ml |
| $MgCl_2$ (10% strength solution) | 2 ml |
| water (0° German hardness), perfume, dyestuff, ad | 100% |

EXAMPLE 5

| | |
|---|---|
| Di-stearyl-dimethylammonium chloride | 30% |
| oleyloxypropylamine + 20 EO | 7% |
| $H_3PO_4$ (1 molar) | 6 ml |
| $MgCl_2$ (10% strength solution) | 2 ml |
| water (0° German hardness), perfume, dyestuff, ad | 100% |

All dispersions of the Examples 1 to 5 are of low viscosity and can be easily diluted in cold water.

What is claimed is:

1. A concentrated fabric softener having stability against phase separation and gel formation consisting substantially of (a) 30 and up to 50 weight % of a compound of the formulae

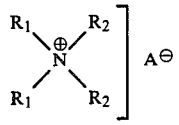

(I)

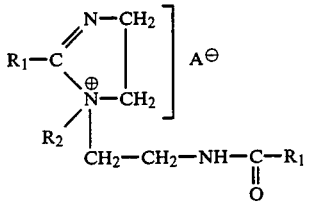

(II)

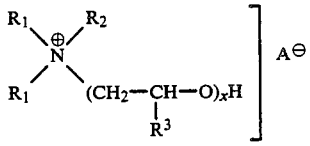

(III)

in which $R_1$ is alkyl or alkenyl having from 8 to 22 carbon atoms, $R_2$ is alkyl having from 1 to 4 carbon atoms, $R_3$ is methyl or hydrogen, x is a number of from 1 to 5 and A is an anion such as $Cl^{(-)}$, $Br^{(-)}$, $CH_3O$-$SO_3^{(-)}$ or $CH_3OSO_3^{(-)}$;

(b) from 2 to 20 weight % of a fatty amine polyglycol ether of the formula IV

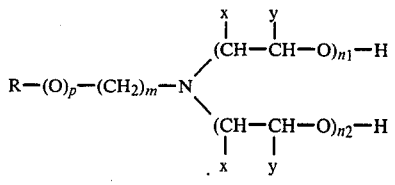

(IV)

in which R is alkyl or alkenyl having from 8 to 22 carbon atoms, x and y each are hydrogen or methyl with the proviso that x and y are not simultaneously methyl, $n_1$ and $n_2$ together are an integer of from 2 to 50 and p and m either are simultaneously zero, or p is 1 and m is 1, 2 or 3;

(c) from 3 to 30 weight % of a $C_1$–$C_3$-alcohol;

(d) an acid in an amount which is equimolar to component (b), and (e) water in an amount remaining to complete 100%.

2. A concentrated fabric softener as claimed in claim 1 having stability against phase separation and gel formation and consisting substantially of 30 to 40 weight % of component (a), from 2 to 5 weight % of component (b) and from 5 to 15 weight % of a $C_1$–$C_3$ alcohol.

3. A concentrated fabric softener as claimed in claim 1 having stability against phase separation and gel formation and consisting substantially of from 30 to 40 weight % of component (a), from 4 to 10% of component (b), from 5 to 15 weight % of a $C_1$–$C_3$ alcohol and up to an effective amount of a conventional auxiliary.

4. A concentrated fabric softener as claimed in claim 1 having stability against phase separation and gel formation, wherein $n_1$ and $n_2$ together are an integer of from 20 to 30.

5. A concentrated fabric softener as claimed in claim 1 having stability against phase separation and gel formation wherein, in formulas (I), (II) and (III), $R_1$ is alkyl or alkenyl having 16 to 18 carbon atoms and $R_2$ is methyl; and in formula (IV), R is alkyl or alkenyl having 16 to 18 carbon atoms, $n_1$ and $n_2$ together are 25, and m is 3 when p is 1.

* * * * *